United States Patent [19]

Shippee

[11] Patent Number: 4,634,050

[45] Date of Patent: Jan. 6, 1987

[54] FANLESS AIR ASPIRATION SNOWMAKING APPARATUS

[76] Inventor: James H. Shippee, P.O. Box 47, Vernon, Vt. 05354

[21] Appl. No.: 815,839

[22] Filed: Jan. 3, 1986

[51] Int. Cl.[4] ..... A01G 15/00; E01H 13/00; A62C 1/12; B05B 7/10

[52] U.S. Cl. ..... 239/14.2; 239/10; 239/405; 239/DIG. 7; 239/2.2

[58] Field of Search ..... 239/2 S, 10, 14, 405, 239/406, DIG. 7; 417/151, 171, 179, 197

[56] References Cited

U.S. PATENT DOCUMENTS 3,760,598 9/1973 Jakob et al. ..... 239/2 S X
4,028,009 6/1977 Gudzenko et al. ..... 417/179

FOREIGN PATENT DOCUMENTS 2376384 7/1978 France ..... 239/14
929121 6/1963 United Kingdom ..... 239/DIG. 7

*Primary Examiner*—Andres Kashnikow
*Assistant Examiner*—Patrick N. Burkhart
*Attorney, Agent, or Firm*—Sughrue, Mion, Zinn, Macpeak, and Seas

[57] ABSTRACT

A concentric multiple tube assembly forms an axial eductor passage for educed ambient air flow unobstructed from the inlet end to the outlet end. Ambient air eduction occurs as a result of ejection of compressed air or compressed air and water via at least one set of compressed air and water ejection orifices oblique to the inner tube sidewall defining the eductor passage and at a skewed trajectory angle such that the compressed air streams attach to the inner tube side wall opposite the orifices ejecting the same via Coanda effect. By wall attachment, a water film on the tube inner wall enhances the cooling effect of the air stream passing therethrough by evaporation thereof. Compressed air and water are delivered to annular chambers within the tubular assembly. Preferably, water mixes with the compressed air in one of the chambers prior to ejection into the eductor passage. A circumferential set of outlet end air and water ejection nozzles eject compressed air and water in jet form at circumferentially spaced positions parallel to and about the air/water stream discharging from the outlet end of the assembly.

16 Claims, 5 Drawing Figures

FIG. 2
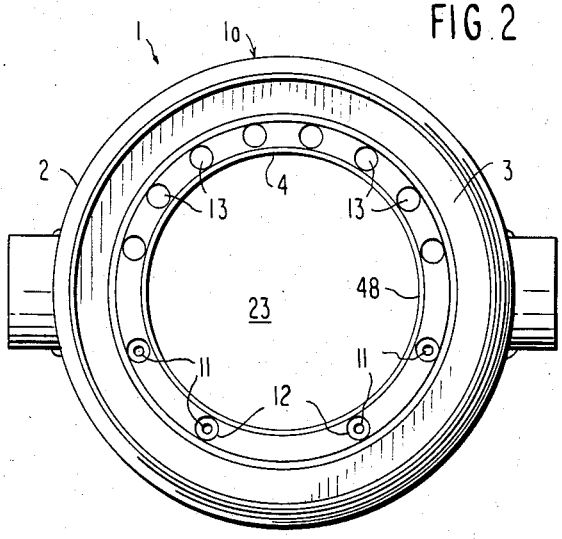
FIG. 3
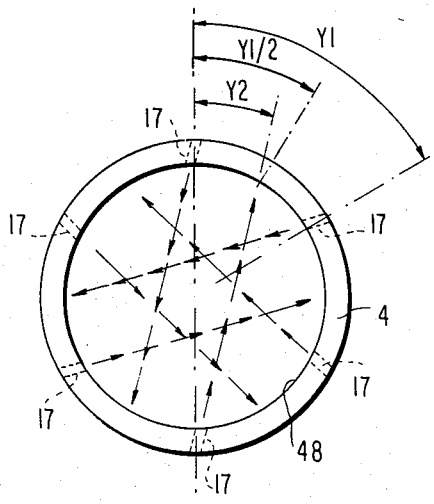
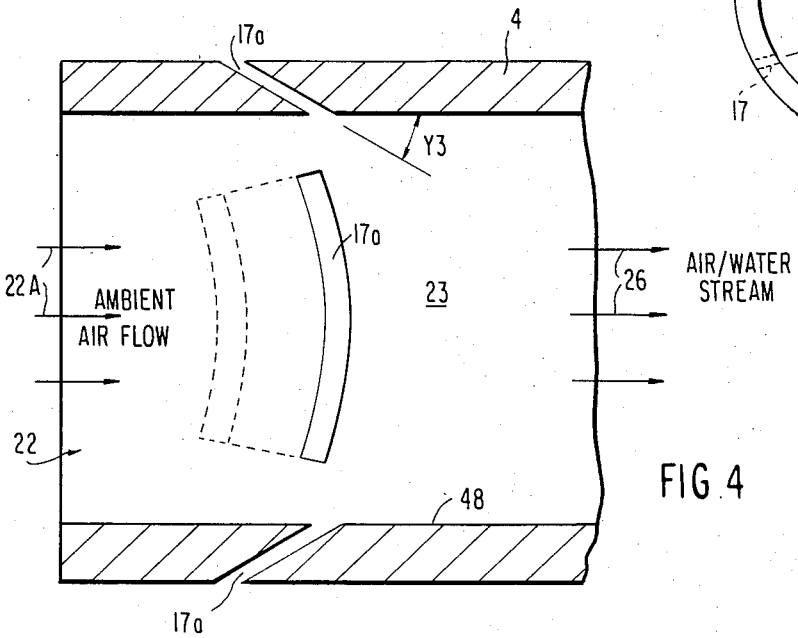
FIG. 4
FIG. 5
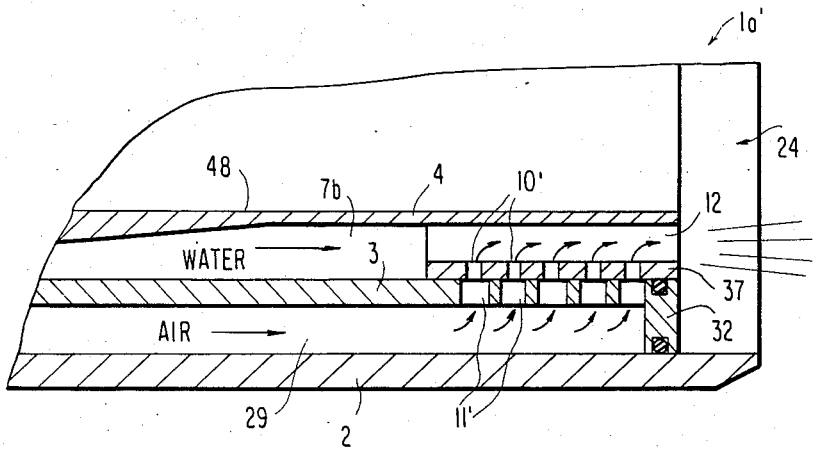

FANLESS AIR ASPIRATION SNOWMAKING APPARATUS

FIELD OF THE INVENTION

This invention relates to snowmaking and, more particularly, to an apparatus for fanless ambient air aspiration which facilitate the evaporation effect useful in making snow in vast quantities utilizing low energy consumption.

BACKGROUND OF THE INVENTION

Due to the high cost of energy, there is a continuing need to reduce the cost of making artificial snow, particularly by reduced compressed air consumption. The majority of the ski areas require the use of snowmaking machines throughout the season to ensure complete coverage of the slope and sufficient snow accumulation to ensure excellent skiing conditions on all slopes. A number of snowmaking devices involve electric motor driven fans using little or no compressed air in the process of snowmaking. The initial cost of this equipment is rather expensive, but the expense of operation is generally less than that of the more conventional air/water snow guns utilizing compressed air and water under pressure. Such air/water snow guns are, to the opposite, low in initial cost but much more expensive to operate in terms of the total energy required to operate the same in the production of a given snow volume.

U.S. Pat. 3,760,598 to Jakob et al, issued Sept. 25, 1973, is representative of the motor-driven fan-type of snowmaking machine. A large cylindrical carrier supports interiorly at the inlet end, an electric fan 36 driven by a motor creating a circulation of fan-driven air passing axially through the front end of the cylindrical carrier for the fan and motor. At the outlet end of the cylindrical carrier, a plurality of nozzles open to the exterior of the unit in a direction parallel to the air flow passing through the center of the cylindrical carrier. Compressed air is fed from the manifold to respective nozzles and the nozzles also receive water under pressure from an annular manifold. High pressure air added to the water and discharged from the nozzle in the form of tiny bubbles expands suddenly upon leaving the nozzle to lower the water temperature significantly of the water, leading to a quick formation of ice crystals in the boundary layers between the bubbles of expanded air and the surrounding small droplets of water to generate the nuclei for the promotion of the transformation of water into snow. Further, a nucleating agent may be admixed with the air-permeated water flow, and, in comminuted crystalline form. Alternatively or in addition, a surfactant in powdered or liquid form may be added to the water to reduce its surface tension, thereby facilitating its dispersion into fine droplets and increasing the quantity of snow produced for a given amount of energy required to operate the fan and pump the water and surfactant fed under pressure to the nozzles and compressing the compressed air stream simultaneously fed to the nozzles with the water. U.S. Pat. No. 3,760,598 is exemplary, therefore, of a high-efficiency fan-type snowmaking apparatus.

U.S. Pat. No. 4,353,504 to Girardin et al is an example of the more conventional air/water snow guns with a large diameter cylindrical hollow body which mounts internally a compressed air supply conduit or passageway terminating in an injection nozzle whose discharge orifice is convergent-divergent. A needle valve accommodated inside the compressed air supply conduit or passageway permits precision adjustment of the outlet cross-sectional area of a discharge orifice of the injection nozzle. A pressurized water supply conduit or passageway opens at an angle into the annular space between the hollow body and the central compressed air supply conduit or passageway. The hollow body terminates forwardly beyond the injection nozzle in a frustoconical wall leading to a small diameter mixing chamber aligned with the injection nozzle constituted by the bore of a main nozzle which diverges at its discharge end remote from the injection nozzle.

Various attempts have been made to compromise between the cost of the equipment and the expense in operation. In U.S. Pat. No. 4,383,646 to Smith, water is ejected by impingement into an air stream creating atomization of the water and projection of both water and air. It is known that only a small percentage of the total energy required to freeze the water comes from refrigeration of the decompressing air. The balance of the energy comes from the ambient air in two ways: evaporational cooling and direct heat transfer to the ambient air as a law of mixtures. By increasing relative velocity, the cooling effect is increased. In many air/-water snow guns, the velocity of the compressed air leaving the nozzle is supersonic or nearly so with the initial water velocity being generally subsonic. The water then accelerates with the expanding compressed air which establishes one phase of air and water relative velocity within the stream. This defines another velocity relationship to ambient air. However, in a very short time, these relative velocities decrease to only a few feet per second as the adjacent ambient air accelerates and the projected air/water from the nozzle decelerates. Therefore, the evaporational cooling process diminishes to the point given only to the water particles free falling to the surface.

U.S. Pat. No. 4,353,504 to Girardin et al gives increased consideration to the evaporation effects in the design of the nozzle and in terms of the nozzle length. U.S. Pat. No. 3,969,908 to Lawless adds a vortex chamber using compressed air for added air flow around the aspirated water. U.S. Pat. No. 3,774,843 to Wright tends to improve the snowmaking process by confining the compressed air in a chamber for a brief period. U.S. Pat. No. 3,301,485 to Tropeano uses a vortex section for aspirating cold ambient air within that snowmaking device. In U.S. Pat. No. 3,760,598 to Boese, a combination of fan air and compressed air is employed as well as precooled water. In the larger fan devices, a fan supplies large volumes of ambient air for the cooling requirement as well as keeping the water particles aloft for longer periods of time. Such is disclosed by U.S. Pat. No. 4,223,836 to Eager.

It is, therefore, a primary object of the present invention to provide a snowmaking apparatus and method of snowmaking utilizing more of the available BTU's as a result of vaporization of the water while utilizing both extremely small particles for increased freezing rates in conjunction with larger, wetter particles which join for a larger structural snow flake when desirable.

SUMMARY OF THE INVENTION

The present invention is based in part on the area/-volume relationship of a water particle (sphere) which is proportional to the square of its radius with respect to area and to the cube of its radius with respect to its volume. To double the radius of a given droplet size quadruples its area ($2^2=4$) and increases the volume eight times ($2^3=8$). Thus, by doubling the particle size, the time to freeze the particle is also doubled as the overall ratio is doubled.

The invention is directed to what may be considered a hybrid type of snowmaking machine, i.e., a fan-type snowmaking device without the fan. The invention is predicated on utilizing the educting effect of small jets of compressed air or a combination of air and water passing through and along the surface of a nozzle wall to drive ambient air through the interior of a nozzle defined by an inner duct under sidewall attachments or Coanda effect and is based on the principle of "fanless" ambient air aspiration.

In the conventional air/water-type snow guns utilizing compressed air and water under pressure fed thereto, mixed and jetted from the discharge end of the snow gun, compressed air and water are mixed, atomized and projected aloft in a number of ways, all of which strive to attain a water particle, generally as small as possible. One assumption is that the compressed air is most responsible for production of snow. The applicant's theory follows. At an assumed ambient air temperature of 32° F., if water were at that temperature, then there is no temperature differential between the water and the air. Hence, there is little transfer of heat energy required for freezing to occur. In terms of the British Thermal Unit (BTU), it takes 1 BTU to change the temperature of water one degree Fahrenheit. This is true throughout its liquid state and is the basis for a specific heat value of 1.00. However, for water as a liquid to change to a solid (ice), a structural change must take place. This is called a phase change or latent heat of fusion and requires 144 BTU of heat energy per pound of water. Meanwhile, the temperature of the water remains at 32° F. as the heat is removed. Pure, undisturbed water may sometimes be supercooled, that is, cooled below 32° F. (0° C.) without freezing. Eventually, however, at temperatures varying from −1° C. to −20° C., all water will freeze and the temperature will rapidly rise to 0° C. where it remains until all water is frozen. A similar phase change occurs at 212° F. (100° C.) called heat of vaporization or evaporation and requires 970 BTU per pound of water to change the state from liquid to gas. An example of this cooling effect may be seen by water evaporating from a wetted finger. Human bodies cool themselves by vaporization of body fluids (sweat).

It, therefore, appears that 144 BTU will be necessary to freeze 1 pound of water or 1,200 BTU per gallon ($144\times8.33$ ppg), assuming there is no other heat exchange. The question occurs as to how much cooling energy can be obtained from a unit of compressed air; in snowmaking in the United States, the air/water ratio is determined by dividing a cubic foot of air per minute, SCFM (free cubic feet per minute) by the water volume employed in gallons per minute, GPM. Due to the fact, by and large, that the energy in compressed air is a component not only of its volume but also its pressure, a more recent method for computing air consumption is one expressed in horsepower. A rule of thumb is 5 SCFM per horsepower at 100 psig. These air/water ratios are used to compare the performances of snowmaking equipment under various conditions. The equation for BTU versus compressed air is as follows:

$$(P\times Q)/11.8=\text{BTU/Minute}$$

where P is the pressure in psig of the compressed air and Q is the flow rate of free air (SCFM). 100 SCFM at 100 psig will produce 847.5 BTU/M of heat energy during compression. If no heat were removed and the pressure were released, the air would return to its original temperature. On the other hand, if the heat of compression were removed to approximately that of ambient air temperature, then the same relative heat (cooling) energy returns as refrigeration. Thus, the 847.5 BTU/M is capable of freezing 5.88 pounds of water at 32° F. ($847.5-144=5.88$). This equates to 0.786 GPM. Further, it suggests an air/water ratio of 127.1 to 1 (100 SCFM-0.786 GPM). Further, it suggests an air/water ratio of 127.1 to 1 (100 SCFM-0.786 GPM). An average performance, of an air/water gun at 32° F., however, might range from 40-1 to 20-1. This would be 2.5 to 5.0 GPM for each 100 SCFM of air. The energy required to freeze 2.5 to 5.0 GPM at 32° F. reduced by 847.5 BTU/M for the compressed air energy, leaves a balance of 68.53 to 84.26% (1846 to 4538 BTU/M) which must come from another source, namely evaporational cooling. It would appear then that only 31.47 to 15.47% of this energy comes from the compressed air. The balance of the heat must then be dissipated into the ambient air. The specific heat thereof is 0.171 per pound or 0.0132 per cubic foot. Even at 28° F. (4° F. Delta T), as much as 85,947 cubic feet of air would be required every minute if it were not for evaporational cooling. That is, a cubic volume of some 44 feet in each of the three orthogonal directions. This is hardly the case as fan-driven machines may convert on the order of 70 GPM with 16,000 SCFM (15 HP fan, plus 15 HP compressed air), as disclosed by the September 1985 issue of Ski Area Management, pages 68–69. Whereas an air/water gun may only freeze 35 GPM with 560 SCFM (112 HP) of compressed air. In terms of horsepower, it is obvious that a fan-driven snow maker is 7.47 times more efficient, yet SCFM for SCFM should be able to freeze 1000 GPM making them only 7% efficient in terms of the evaporational cooling energy available.

The applicant has realized that the best possible source of high-efficiency cooling energy in the process of snowmaking lies in the cooling effect achieved by evaporation. The applicant has realized that if 1 pound of water were to vaporize, 970 BTU is exchanged, yet only 144 BTU stand required to freeze a pound of water at 32° F. This means that if only this much energy stands required, if 12.93% of the water available were to evaporate, 125.4 BTU would be released, sufficient to freeze the balance of 87.07% of the water ($0.8707\times144=125.4$ versus $0.1293\times970=125.4$). Under such conditions, the water vapor is not per se absorbed into the air but displaces it, with the moist air being as much as $\frac{5}{8}$ lighter than dry air.

BRIEF DESCRIPTION OF THE DRAWINGS

FIG. 2 is a front elevational view of the apparatus of FIG. 1.

FIG. 3 is a schematic view of the inner duct of the apparatus of FIG. 1 illustrating conceptually the nature of compressed air and water ejection with entrained water through the nozzle bore of the apparatus under conditions in which ambient air is aspirated by the compressed air and water jet streams.

FIG. 4 is a longitudinal sectional view of a portion of a further snowmaking apparatus forming a second embodiment of the present invention.

FIG. 5 is a longitudinal sectional view of a portion of a modified snowmaking apparatus forming yet another embodiment of the invention.

DESCRIPTION OF THE PREFERRED EMBODIMENTS

Figure 1:
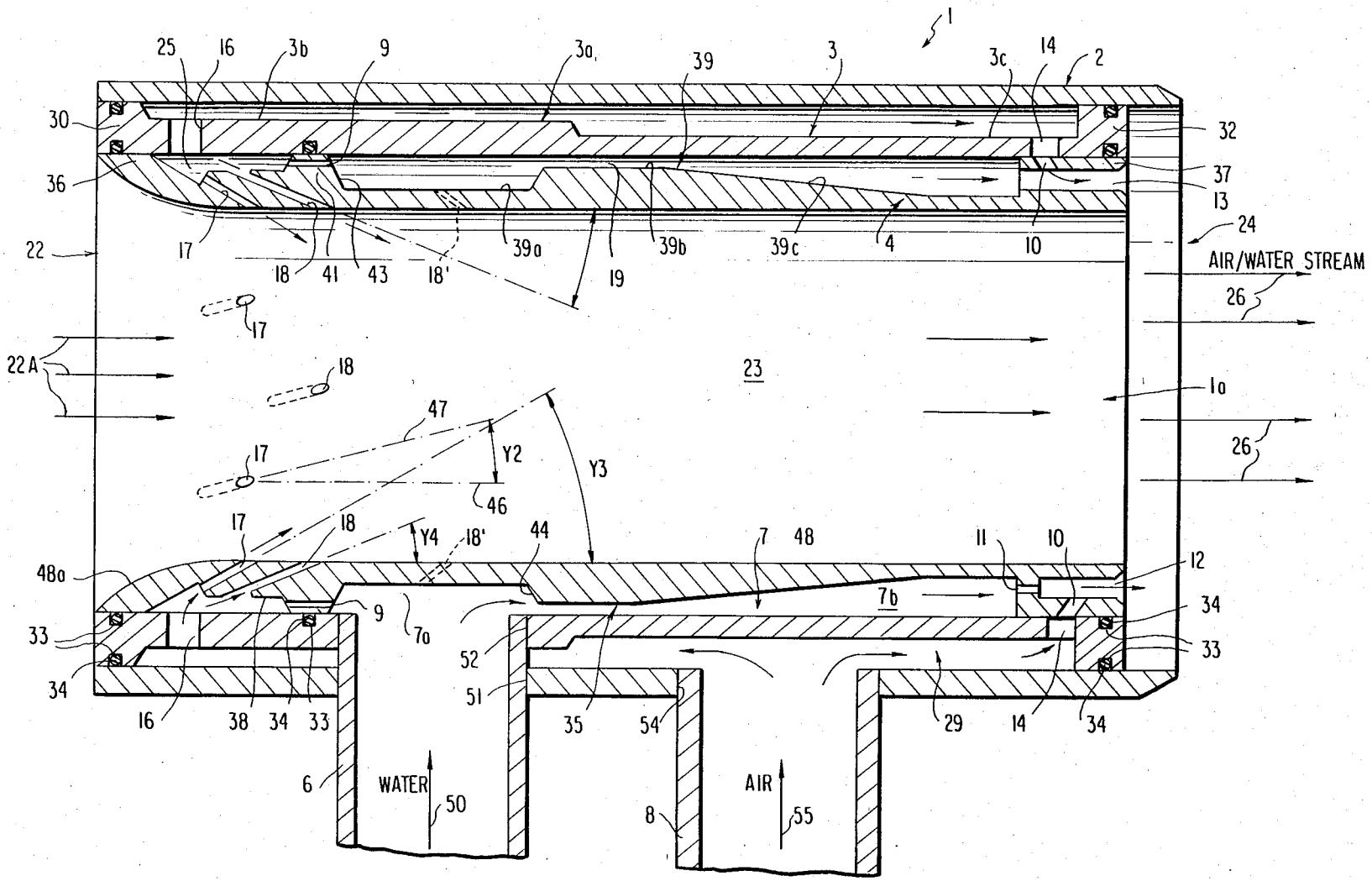
FIG. 1 is a longitudinal sectional view of a fanless air aspiration snowmaking apparatus forming a preferred embodiment of the present invention.

Referring first to FIGS. 1, 2 and 3, the fanless air aspirating snowmaking machine in one form is illustrated generally at 1 and is composed principally of augmenting eductor assembly 1*a*. Assembly 1*a* is constituted principally by a series of concentric cylindrical tubes: an outer tube 2, a central or intermediate tube 3 and an inner tube 4. The tubes are preferably made of a metal such as aluminum, the outer tube 2 is of a constant thickness over the full extent of its length, while the central or intermediate tube 3 and the inner tube 4 vary in thickness and are in sealed abutment with each other at their ends. The intermediate tube 3 is in sealed abutment, at its ends with the inner periphery of outer tube 2. The assembly 1*a* may be demountable, that is, the tubes 2, 3 and 4 separated from each other, and, appropriately, portions of the tubes may carry O-ring seals or the like to maintain the fluid seal between the tubes at their opposite ends within assembly 1*a*. The outer periphery 3*a* of central tube 3 is machined or otherwise formed with a first peripheral recess 3*b* from the front end or inlet 22 of the augmenting ejector assembly and is further step recessed at 3*c* towards the outlet end 24 of the augmenting ejector assembly 1*a*. Recesses 3*b*, 3*c* define inlet end flange 30 and outlet end flange 32, with the flanges 30, 32 having an outer diameter on the order of the inner diameter of tube 2. Both the inlet and flange 30 and outlet end flange 32 of the intermediate tube 3 are provided with circumferential grooves as at 33 on either or both the inner and outer peripheries thereof within which are mounted O-ring seals as at 34 and which form seals between the tubes 2, 3 and 4 at the inlet and outlet ends 22, 24 of the augmenting eductor assembly 1*a*. Seals may be effected by tube interference fit between these members. As such, a first sealed annular outer chamber 29 is formed between the outer tube 2 and the intermediate tube 3. Chamber 29 is supplied with compressed air from a source indicated by arrow 55 which opens to the chamber 29 via a hole 54 within the outer tube 2 within which projects in a sealed and coupled manner compressed air supply hose or pipe 8.

Inner tube 4 which forms eductor passage 23 has a constant inner diameter over much of its length as a smooth bore inner wall surface 48 from inlet end 22 to outlet end 24 of the ejector assembly 1*a*. At the inlet end 22, the wall 48 of inner tube 4 flares outwardly forming a converging nozzle inlet surface portion 48*a*. The outer periphery 35 of the inner tube 4 is provided with a first annular recess or groove 38 which is relatively shallow and a further annular groove or recess 39 which is significantly deeper and which extends over the major length from radial collar 41 of inner tube 4 separating the grooves or recesses 38 and 39. Grooves 38, 39 further define inlet end radial flange 36 and outlet end radial flange 37 for inner tube 4. The annular recess is comprised of a first relatively deep portion 39*a*, a much shallower portion at 39*b* and, finally, an expanded portion 39*c* leading to the outlet end flange 37. It should further be appreciated that the end wall 43 of collar 41 at recess portion 39*a* is oblique, as is the end wall or shoulder 44 at the opposite end of the radially enlarged recess portion 39*a* is oppositely oblique such that the groove portions 39*a*, 39*b* and 39*c* define a converging-/diverging flow passage including a reduced cross-sectional throat area 19.

With respect to inner chamber 7 portions 7*a*, 7*b* and the narrowed throat annular passageway 19, while the appearance is similar to that of a venturi, it has no similar application since the water flow is of an incompressible liquid. The relatively large volume annular chamber section 7*a* functions to ensure water flow from water supply or inlet pipe 6 around the full circumference of the assembly 1*a* with negligible pressure restriction. The convergence leading to the narrowed throat or passageway 19 is to ensure water flow to the upper portion of the nozzle, even with that to the lower portion, in spite of gravity effect, especially when air is present in the water flow and emanating from orifices 9 or during low water pressure flow. The diverging chamber section 7*b* permits dimensional increase of the chamber to provide access to the outlet end orifices or nozzles 12, 13 without creating turbulent water flow to those orifices.

It should be appreciated that radial collar 41 separates a first, upstream, compressed air and water injection inner chamber 25 defined by the intermediate tube 3 and the inner tube 4 and a second, downstream inner water supply chamber 7. The chambers 25 and 7 are sealed from each other by means of a circumferential groove 33 within the inner periphery of the intermediate tube 3, facing collar 41, and at O-ring seal 34 provided therein, or otherwise. A series of horizontal very small diameter holes or orifices 9 pass through the radial collar 41 so as to provide limited communication between chambers 25 and 7. At the downstream or outlet end 24 of the augmenting eductor assembly, a plurality of horizontal orifices 11 of small diameter are drilled within the outlet end flange 37 of inner tube 4, within the lower half of tube 4, which open to larger diameter orifices 12, as extensions thereof. Orifices 12 define a lower set of circumferentially spaced, outlet end, compressed air and water ejection nozzles. These correspond to large diameter orifices 13 within top half of tube 4 defining a set of upper, outlet end, compressed air and water ejection nozzles. Further, a series of radial holes 14 are provided within the inner tube 3 at the outlet end flange 32 of that member, which open to aligned oblique orifices or holes 10 within the outlet end flange 37 of the inner tube 4 from the outer periphery of that member inwardly which intersect orifices 12, 13. Communication is effected between chamber 25 and inner tube 4 nozzle bore or eductor passage 23 of the augmenting eductor assembly 1*a* via at least one series of circumferentially spaced compressed air ejection orifices or holes as at 17 which may be drilled holes. Alternatively, a continuous slot 17*a* may be employed as shown in the embodiment of FIG. 4.

The holes or orifices 17 are in a circular array over the complete circumferential extent of the inner tube 4 and are circumferentially spaced from each other by an angle Y1, FIG. 3. Additionally, and as may be seen by reference to FIGS. 1 and 3, the angulation is such that flow of fluid through the orifices 17 has an off-center or skewed trajectory as defined by angle Y2. Angle Y2, FIG. 1, is an angle formed between a line 46 parallel to the axis of the concentric tube assembly 1*a* and the axis or center line 47 for each hole or orifice 17 as at 47. In the illustrated embodiment of FIGS. 1–3, the off-center trajectory angle Y2 is approximately ¼ of the value of the circumferential spacing angle Y1. This ensures that a compressed air or air/water stream entering the eductor passage 23 and expanding will strike inner wall 25 to the opposite the side of orifice 17 from which it emanates to produce a desired Coanda, wall attachment effect for such flow on the opposite tube inner wall surface 48, rather than having the jet streams converge at the center of tube 4. Further, the axis 47 of each compressed air ejection orifice or hole 17, forms with the constant diameter surface of tube inner wall surface 48, an acute angle Y3. This angle may vary, but within the range of 20° to 50° a Coanda effect will occur adjacent the inner surface 48, at the opposite side of inner tube 4 by the passage of compressed air through the drilled holes or orifices 17. Each expanding accelerating compressed air or air/water steam is capable of educting, i.e., aspirating, ambient air, as per arrows 22A from inlet end 22 of the assembly through the assembly eductor passage 23 in the direction of outlet end 24. Orifices 17, as shown may constitute a single circumferential array of a number of such orifices at a given circumferential spacing.

Alternatively, there may be multiple-stage compressed air and/or air/water ejection through a second or third stage. In the illustrated embodiment of FIG. 1, a series of second-stage air or air/water ejection orifices 18 are shown, in which case the orifices open to the eductor passage 23 at an acute angle Y4 which is somewhat smaller than the acute angle Y3 for the orifices or holes 17. In the hybrid, fanless air aspirating snowmaking machine or gun 1 of the present invention, the snowmaking process is facilitated by the expansion of the compressed air, the increased velocity of the same, the aspiration of ambient air through the inlet end 22 of the eductor passage 23 and the Coanda effect of the air stream flowing over the interior wall surface 48 of inner tube 4 and attachment thereto. This action produces, as a positive effect, increased vaporization of water in particle form within the air and water stream 26 passing through eductor passage 23 that materially enhances the snowmaking process and increases the output thereof. Applicants' system utilizes to a great extent the cooling effect resulting from vaporization of the water particles to reduce the outside energy requirements necessary to produce snow making. Specifically, the apparatus is capable of producing more snow relative to the energy necessary to compress the air flowing to chamber 29 and to pump water supplied initially to chamber 7. In that respect, water under pressure from a source indicated by arrow 50 enters chamber 7 through a water supply hose or pipe 6 which passes sealably through opening 51 within the outer tube 2 and terminates within opening 52 within the intermediate or central tube 3 and is sealed to tube 3 at that opening.

The compressed air from source 55 entering chamber 29 via pipe 8 flows through a series of holes or ports 16 into annular chamber 25 and is ejected through the series of orifices 17 and 18 as symmetrical, circumferential arrays around the eductor passage 23, at the inlet end 22. The expansion of the compressed air and acceleration of the air streams and the angulation of the same educes ambient air as indicated by arrows 22A to enter the eductor passage 23 which constitutes an expansion nozzle for the compressed air entering that passage.

With respect to water flow, the water under pressure, as evidenced by arrow 50, enters chamber 7 through pipe 6, filling annular chamber 7*a*. Water passes through narrowed chamber portion or throat 19 into the enlarging chamber portion 7*b*. The water ejects generally parallel to but outside of the educted ambient air stream within eductor passage 23 via longitudinal injection orifices 12, 13 at the outlet end 3*c* of the intermediate tube 3, FIG. 2. Importantly, whenever the air pressure in chamber 25 is greater than the water pressure in chamber 7, air will pass through the plurality of drilled holes or orifices 9, if provided, from chamber 25 and will enter chamber 7 to mix with the water. The air/water premix provides for finer atomizing of the water as the water is ejected through orifices 12 and 13. Orifices 12 extend circumferentially about the bottom half of the assembly 1 and are large diameter extensions of the small diameter holes or orifices 11, while the ejection orifices 13 are of a diameter equal to that of orifices 12 but are not extensions of smaller diameter holes. The reason for this is that water ejected from the upper set of orifices 13 has the advantage of falling through the super-cooled, pre-neculiated air stream 26, whereas the the lower orifices do not. The upper orifices 13 operate at lower air/water ratios which constitute the major portion of the total volume which, in part, lends to some of the overall reduced air consumption.

Keeping in mind that smaller water particles are desired at temperatures at or near freezing, i.e., 32° F., the narrowed annular passageway 19 is provided as a restriction for the water flow to assist in the prevention of the air/water premix from separating as it flows longitudinally from the upstream portion 7*a* of chamber 7 to downstream portion 7*b* adjacent orifices 12, 13. If the air is allowed to separate from the water, the result would be mostly air flow through the upper set of orifices 13 and mostly water flow through the lower orifices 11 at the outlet end 24 of assembly 1. There is a larger number of ejection orifices 13 to eject larger volumes of water containing smaller volumes of compressed air within the upper 180° section of assembly 1*a*. The lower 180° section of orifices 12 are preferably fewer in number and purposely designed for ejection of lesser volumes of water and larger volumes of compressed air relative to the air/water ratios of orifices 13. The mix of air and water for both the upper and lower orifices 12, 13 may provide various air/water ratios determined by size, location and number of orifices 10. The function of the different diameter orifices 11, 12 for the lower set of orifices 12 is to define an air/water ratio with a lesser amount of water passing through the small diameter orifices 11 opening to the larger diameter orifices 12. It is within the larger diameter orifices 12 that the air stream enters through radial ports 14 and oblique holes, or annular slots 10 within the outlet end flange 37 of inner tube 4.

As may be appreciated, the overall purpose is to ensure that the water ejected through lower set of orifices 12 below the central air/water stream 26 does not receive full benefit from vaporization cooling and nucleation as it falls to the ground. This will be explained hereinafter. The water ejected through the upper set of orifices 13 above the central air/water stream 26 will be held aloft for longer periods of time and have accelerated freezing as it must fall through the central air/water stream 26. Some fluidic attraction will occur between the lower orifice air/water mixtures emanating from orifices 12 and the central air/water stream 26, holding it aloft. It is beneficial to maintain a closure of air/water around the entire central air stream 26 confining the cooling process resulting from water vaporization to the ice nuclei as long as possible. By design, it is assumed that water pressures less than air pressure will seldom be encountered during actual snowmaking. If so, then a plurality of orifices 18' should be arranged to exit from chamber portion *7a*, radially or oblique into eductor passage 23 upstream or downstream of the sets of orifices 17, 18 for evaporational cooling and nucleation by causing such water to enter into the expanding air streams from orifices 17 and 18 within eductor passage 23.

When the water pressure in chamber 7 is in excess of the air pressure in chamber 5, some water flow will occur through longitudinal holes or orifices 9 into chamber 25, and the air flowing through orifices 18 and expanding will carry some water flow with it for ejection at angle Y4 in the direction of the outlet end 24, preferably without striking the inner wall 25. The number of orifices 18 may be the same as orifices 17 or of a lesser fraction thereof. The orifices 18 should be circumferentially offset from orifices 17, preferably intermediate, as shown in FIG. 1. As water pressure within chamber 7 increases, the flow of water through the restricted passageway 19 or multiple orifices leading from the upstream chamber portion *7a* to the downstream portion *7b*, increases and the amount of water combining with the compressed air within chamber 25 and exiting through the orifice 18 will decrease. Both air and water have ambient air entraining or educting capabilities, but air is the most effective in educting ambient air flow into inlet end 22 of educting passage 23, as evidence by arrows 37, FIG. 1. Some of the water that is ejected from orifices 18 and optional orifices 18', when provided which emanate directly from chamber 7 through the inner tube 4, downstream from orifices 18, will most likely strike the inner wall 25 defining eductor passage 23 where evaporation of the water will take place. The present invention is prefaced on the fact that substantially more evaporational cooling occurs due to the velocities between the air flow and the water streams than occurs in the prior art snowmaking machines discussed previously where air and water mixtures are ejected into ambient air. In most cases in the present invention, the water will be supercooled by this evaporation and be laden with nucleating ice particles. In turn, the water flowing within the confines of passage 7 will be additionally cooled for enhancing the freezing of water and air mixtures emanating from orifices 12 and 13. Water ejected through orifices 13 will mix with air entering from chamber 29 through radial ports 14 and inclined orifices or holes 10. The closer hole 10 is to the inlet end of orifice 13, the smaller the air/water ratio will be at a given pressure. The diameter of orifices 10 will dictate the graphic curve the air/water ratio will follow at various pressures for orifices 13. Additionally, as may be appreciated by reference to the drawings, each orifice 11 is significantly smaller than its extension orifice 12 so that an air/water ratio can be achieved which is sufficiently high to ensure ice particle freezing without aid of cooling from the central air/water stream 26 and under conditions consistent with the cooling requirements of the upper set of orifices 13 at the outlet end 24 of the assembly 1*a*.

Referring to the preferred embodiment of FIG. 1, but applicable to the alternate embodiments described hereinafter, with zero water pressure and no water flow, it is apparent that air will escape from chamber 39 through the series of radial ports or holes 16 and further escape from chamber 25 via the upstream and downstream series of ejection holes or orifices 17 and 18, respectively. Additionally, compressed air will flow through orifices 9. It is the product of the compressed air flow through orifices 17 and 18 which educes ambient air flow 37 through eductor passage 23. Such flow, absent adequate water pressure, will not cause water to be entrained into chamber 25 nor is there any water entrainment in any part of the apparatus shown under conditions where the water pressure within chamber 7 is not in excess of the air pressure within adjoining chamber 25. When, of excess pressure, a flow of water occurs through the small diameter holes or orifices 9 from chamber section *7a* to chamber 25 and the water will mix with the air within chamber 25. As the water pressure is increased, so will be a flow increase across orifices 9, at first mixing with air and exiting from the downstream set of ejection orifices 18. With continued water pressure and flow increase, water could conceivably gain ejection through the upstream set of orifices 17. However, the diameter of the orifices 9 is normally sufficiently smaller than that of orifices 17 and 18 so that the water flow is never capable of totally overcoming the effect of the larger compressed air flows through orifices 17 and 18 to mix with the air passing from radial port 16 to orifices 17 at the opposite side of chamber 25. Obviously, the diameter ratios are purposely engineered in terms of available air pressure against the maximum desired operating water pressure to maximize the capability of the fanless air aspirating snow making machine to make snow with the least amount of energy necessary to compress the air and provide water at the appropriate pressure.

As may be appreciated, multi-stage eduction utilizing one or more sets of ejection orifices 17, 18 is quite advantageous. Air exiting an orifice and supplied at 80 psig has a velocity of approximately 650 feet per second or 443 miles per hour, while in its compressed state. Yet, it has a potential terminal velocity of 4192 feet per second (2858 miles per hour) as it expands. The result is a superior ambient air flow educement compared to that by water at 80 psig ejecting through the same orifice or orifices whose velocity is only 79 feet per second (54 miles per hour). Further, of course, water does not expand. Utilizing orifices 17 and 18, by mixing air and water a mid-velocity is achieved with water entering chamber 25 through the small diameter orifices 9.

One of the purposes discussed previously in air movement is to set up a relative wind between the air and the water particles which creates evaporational cooling. Expanding air mixed with water can do this somewhat itself and, secondly, with the surrounding air.

As an important aspect of the invention, the snow making machine 1 results in a greater volume of ambient air flowing across a nearly stationary water film which results from some of the water particles borne by the expanding compressed air stream adhering to the inner wall 48, as well as increased relative wind beyond the outlet end 24 of eductor assembly 1*a*.

It should be further appreciated that the Coanda effect or sidewall attachment in the current design occurs as result of the compressed fluid ejection streams attaching themselves to the opposite wall surface from the outlet of a given orifice 17, 18 of the series of orifices through which the compressed air (or compressed air and water mixture) expands and enters eductor passage 28 defined by inner tube wall 48.

In other devices utilizing the Coanda effect, sidewall attachment occurs immediately upon fluid ejection, determined partially by the acute angle of the ejection port opening to the expansion area. At the outlet end of the eductor assembly 1*a*, with water pressure being greater than air pressure, the water pressure at the inlet end of orifices 12, 13, and the small diameter orifices 11 leading to orifices 12, is at that higher pressure relationship. However, at the terminal end of orifices 12, 13, the pressure is near zero psig (atmospheric). Along the length of orifices 13 or 11/12, a pressure gradient exists from a variable of high pressure to atmospheric pressure at the discharge end of the orifices or orifice combination.

Somewhere along these orifice lengths, there is a pressure compatible with the designed air pressure, and the location, size, angle of convergence, etc., of ports 10, determines the end result of the air to water ratio discharging from the outlet ends of the orifices 12, 13.

It should also be kept in mind that under certain conditions, ice nuclei will form within the gun which could cause freezing at orifices 17, 18. It is desirable that freezing and the formation of ice nuclei occur at some point downstream of the outlet end 24 of the machine or gun. Generally, such formation occurs 10 to 20 feet beyond the eductor assembly 1*a*. Further, ice nuclei will form to a greater extent as a result of discharge from the lower set of orifices 12 which have higher air to water ratios due to the smaller water orifices 14 than the upper orifices 13, although those orifices have flows with the advantage of falling through the central air stream while the lower orifice flows do not.

A very favorable effect lies in the vaporization of water in the ambient air eductor passage 23 along surface 48, the effect of which is to precool the water passing through chamber 7, as well as any water carried in the air-water stream 26 leading to the outlet end 24 of assembly 1*a*.

While in the prior art snow guns a limited amount of equivalent action occurs, it is Applicant's belief that the enhanced vaporization increases the efficiency of the machine in its creation of snow as well as achieving snow projections well beyond that of non-air operated snow guns.

As a modification and further embodiment of the invention, reference to FIG. 4 shows that for inner tube 4, instead of utilizing a series of circumferentially spaced, oblique holes or air ejection orifices, a sectional or full oblique circumferential slot 17*a* may be provided, in which case, the axis of the slot will be at an angle corresponding to angle Y3 in the embodiment of FIG. 1 for each of the orifices or injection holes 17.

Referring to FIG. 5, an augmenting eductor assembly of modified form is shown at 1*a*′ which utilizes multistage air/water mixing both for orifices 12 and 13. In this case, a series of lower orifices 12 are drilled through outlet end flange 37 of inner tube 4 horizontally, and, additionally, a series of radial ports or holes 10′ are drilled within the flange 37 opening to orifices 12 at right angles thereto. Orifices or holes 10′ are aligned with further air supply or feed holes or orifices 14 upstream of radial flange 32 of the intermediate tube 3 of that embodiment. Compressed air in chamber 29, above the pressure of the water flowing within chamber 7*b*, mixes with the water passing through nozzle bore or orifice 12 with the effect that smaller amounts of water are mixed with the compressed air entering the water stream via radial ports 10′ and gradually accelerated as the air expands due to the pressure gradient along the length of the nozzle bore defined by orifices 12. This lends itself to greater projection of the water particle streams and improved atomization of the water particles as well.

From the above, it may be appreciated that the apparatus of the present invention amplifies the flow of air by using an eductor principle for educting ambient air at the inlet end of a cylindrical inner tube functioning as a flow expansion nozzle. Further, a region of reduced temperature occurs due to the partial vacuum created by the expansion of compressed air leading to the inner tube bore defining an eductor passage. Further, it is within this region that the upstream end of the eductor passage and the converging portion of that passage that a small amount of water or air/water mixture may be introduced, promoting the seed or condensing nuclei required for precipitation. Based on the eductor principle, the system takes further advantage of this air flow and the abundance of ambient air to freeze additional water downstream of the "seed" region. The converging inlet may partially define a Venturi accelerating flow, reducing pressure and effectively lowering the temperature for enhanced atomization of the water particles entering the flow stream at this point within the unit.

While the invention has been described in detail and with reference to specific embodiments thereof, it will be apparent to one skilled in the art that various changes and modifications may be made thereto without departing from the spirit and scope of the invention.

What is claimed is:

1. A fanless air aspiration snow making apparatus comprising:

a hollow tubular member having a cylindrical inner sidewall forming a substantially uninterrupted axial ambient air eductor flow passage and including inlet and outlet ends open to the atmosphere, means carried by said hollow tubular member for ejecting compressed air in jet form into said passage for fluid attachment to said tubular member inner sidewall and for educing ambient air flow through said passage, and means for ejecting water into said compressed air eductor air stream to propagate growth of ice crystals and for increasing the freezing rate of the water by vaporization of water attaching to the inner sidewall of the tubular member, significantly increasing the flow rate of air leaving the outlet end of said hollow tubing member over that of the compressed air educting the ambient air into the flow stream while minimizing the energy requirements in ejecting both compressed air and water into said eductor flow passage.

2. The apparatus as claimed in claim 1, wherein said means for ejecting water comprises means for mixing water with compressed air prior to injecting said compressed air in jet form into said eductor passage.

3. The apparatus as claimed in claim 1, wherein said means for ejecting compressed air in jet form into said eductor passage comprises at least one set of small diameter, circumferentially spaced compressed air ejection orifices passing through said hollow tubular member and opening at the inner sidewall thereof to said eductor passage at an acute angle to said sidewall, in the direction of the outlet end and being skewed at an acute off-center trajectory angle.

4. The apparatus as claimed in claim 2, wherein said means for ejecting compressed air in jet form into said eductor passage comprises at least one set of small diameter, circumferentially spaced, compressed air ejection orifices passing through said hollow tubular member and opening at the inner sidewall thereof to said eductor passage at an acute angle to said sidewall, in the direction of the outlet end and being skewed at an acute off-center trajectory angle.

5. The apparatus as claimed in claim 3 wherein said at least one set of orifices comprises first and second longitudinally spaced sets of small diameter circumferentially spaced compressed air ejection orifices passing through said hollow tubular member and opening at said inner sidewall to said eductor passage at an acute angle to said sidewall in the direction of the outlet end and being skewed at an acute off-center trajectory and wherein said means for ejecting water into said educted ambient air stream comprises said second set of circumferentially spaced air ejection orifices.

6. The apparatus as claimed in claim 5, wherein said first and second set of orifices are adjacent the inlet end of said hollow tubular member.

7. The apparatus as claimed in claim 3, wherein said inlet end of said hollow tubular member annular inner sidewall converges in a direction toward said outlet end and said at least one series of circumferentially spaced orifices is downstream of said converging surface portion of said inner sidewall.

8. The apparatus as claimed in claim 1 further comprising an outlet end set of circumferentially spaced compressed air and water ejection nozzles within said hollow tubular member at said outlet end extending generally parallel to said compressed air educted ambient air stream discharging from the outlet end of said hollow tubular member, and positioned radially outside of said eductor passage and said apparatus further comprises means for supplying a mixture of water and compressed air to said outlet end set of air and water ejection nozzles.

9. The apparatus as claimed in claim 8, further comprising means for setting the air/water ratio of the compressed air/water streams ejected from the set of outlet end ejection nozzles lying beneath the educted ambient air stream, above that of the outlet end nozzles positioned above that stream.

10. The apparatus as claimed in claim 3, wherein said hollow tubular member comprises a tubular assembly including at least two concentric tubes including an inner tube defining said eductor passage and partially a radially inner chamber, means for supplying compressed air to said radially inner chamber, said at least one set of compressed air ejection orifices opening through said inner tube to said radially inner chamber, means defining an annular water supply chamber separate from but in proximity to said radially inner chamber, and small diameter passage means communicating said inner chamber to said water supply chamber such that with the water pressure in said water supply chamber in excess to the air pressure at said radially inner chamber, some water enters said radially inner chamber to mix with the compressed air for ejection through said at least one set of orifices opening to the eductor passage at said tubular member inner sidewall.

11. The apparatus as claimed in claim 3, wherein said hollow tubular member comprises a tubular assembly comprised of an outer tube, an intermediate tube and an inner tube, said tubes being separated from each other over a portion of their length and being sealed to each other at their ends and defining radially inner and outer chambers, means for supplying water under pressure to said inner chamber, means for supplying air under pressure to the outer chamber, means closing off a portion of said inner chamber from said water supply means to form over a length of said tubular assembly a compressed air injection chamber, a series of circumferentially spaced radial ports within said intermediate tube communicating said outer chamber to said compressed air injection chamber, said at least one set of circumferentially spaced ejection orifices opening to said compressed air chamber, a plurality of small diameter orifices communicating said inner chamber portion open to said water supply means to said compressed air injection chamber for permitting water to enter the compressed air injection chamber and to mix with the compressed air such that compressed air and water is ejected through said at least one set of circumferentially spaced air ejection orifices into the eductor passage, an outlet end set of compressed air and water ejection nozzles within said tubular assembly at said outlet end of said hollow tubular member and extending parallel to said eductor stream and radially outside thereof, said outlet end nozzles opening to said inner chamber portion supplied with water under pressure and at least one set of radial ports communicating said outlet end nozzles to said outer chamber and the compressed air therein downstream of the connection thereof to said inner chamber for causing the compressed air to mix with the water passing therethrough and for accelerating water flow by air expansion thereof to atmospheric pressure within the outlet end nozzles prior to exiting therefrom at the downstream end of said outlet end nozzles.

12. The apparatus as claimed in claim 11, wherein said outlet end compressed air and water ejection nozzles above the educted ambient air stream are of constant diameter over the complete length of the same and wherein, the outlet end nozzles lying beneath the educted ambient air stream have portions of reduced cross sectional diameter at their ends proximate to said inner chamber portion communicating with said water supply means and upstream of said at least one radial port opening to said outer chamber.

13. The apparatus as claimed in claim 11, wherein said inner chamber communicating with said water supply means comprises, in order, in the downstream direction, a relatively large annular chamber portion opening directly to the water supply means, a narrow annular restriction and a diverging chamber portion communicating with said outlet end nozzles such that annular distribution of the water over the complete circumference of the tube assembly is effected for insured supply of water to the outlet end nozzles about the top of the tube assembly.

14. The apparatus as claimed in claim 11, wherein, said at least one set of radial ports communicating said outer chamber carrying said compressed air with the interior of said outlet end nozzles comprises a series of longitudinally spaced ports opening to each outlet end nozzle for staging the flow of compressed air into each outlet end nozzle for improved air/water mixture during passage therethrough, minimization of water particle size and staged acceleration of the water particles borne thereby.

15. The apparatus as claimed in claim 1, wherein, said tubular member is of constant internal diameter over at least the major portion of its length.

16. The apparatus as claimed in claim 11, wherein, said tubular assembly inner tube is of constant inner diameter, said outer tube is of constant inner diameter, said inner tube and said intermediate tube comprise radial flanges at their ends, said flanges of said inner tube being sealed to said intermediate tube and said intermediate tube flanges being sealed to said outer tube, said inner tube having a radial collar on the exterior thereof, spaced from its flanges of a radius equal to that of its flanges, separating said outer chamber into a upstream air injection chamber and a downstream water supply chamber, said inner tube having its outer periphery recessed from said collar to its flange at the outlet end of the assembly to define a relatively large inner chamber portion for distribution of water under pressure completely circumferentially about said assembly, a narrowed annular passage longitudinally downstream from said radial collar to effect pressurization and an increasing volume chamber portion downstream thereof, and wherein said outlet end ejection nozzles are within the flange of said inner tube and open at one end to said enlarging downstream water supply chamber for supply of water under pressure thereto, and wherein intermediate tube includes a series of circumferentially spaced radial ports at opposite ends thereof, adjacent said flanges and wherein certain ones of said radial ports open to said upstream compressed air injection chamber and others of said radial ports open to said set of outlet end compressed air and water ejection nozzles via circumferentially aligned ports within the flange of said inner tube at the outlet end thereof, for mixing air with the water passing therethrough, for forming small size water particles and for accelerating the same during expansion of the compressed air within said outlet end nozzles and discharge thereof.

* * * * *